United States Patent [19]

Herrington

[11] Patent Number: 4,619,638

[45] Date of Patent: Oct. 28, 1986

[54] SPLAYED ROLL FOLDER FOR ADHESIVE APPLICATION

[75] Inventor: F. John Herrington, Holcomb, N.Y.

[73] Assignee: Mobil Oil Corporation, New York, N.Y.

[21] Appl. No.: 429,372

[22] Filed: Sep. 30, 1982

Related U.S. Application Data

[62] Division of Ser. No. 297,523, Aug. 28, 1981, Pat. No. 4,419,087.

[51] Int. Cl.[4] ..... B31F 1/00

[52] U.S. Cl. ..... 493/439; 493/444

[58] Field of Search ..... 493/225, 243, 406, 407, 493/419, 422, 424, 434, 442, 928, 439, 444; 53/158; 26/103, 104; 223/28

[56] References Cited

U.S. PATENT DOCUMENTS

| | | | |
|---|---|---|---|
| 2,024,618 | 12/1935 | Whiting | 26/103 X |
| 2,560,039 | 7/1951 | Harlow | 26/104 |
| 2,901,951 | 9/1959 | Hochfeld | 493/442 |
| 3,543,365 | 12/1970 | Helminen | 26/104 X |
| 3,897,943 | 8/1975 | Head et al. | 493/434 |

FOREIGN PATENT DOCUMENTS

| | | | |
|---|---|---|---|
| 783467 | 4/1968 | Canada | 493/438 |
| 1110507 | 7/1961 | Fed. Rep. of Germany | 493/407 |
| 707154 | 6/1950 | United Kingdom | 493/439 |
| 624969 | 9/1978 | U.S.S.R. | 223/28 |

OTHER PUBLICATIONS

American Heritage Dictionary, p. 951, second edit.

*Primary Examiner*—John Sipos
*Assistant Examiner*—Steven P. Weihrouch
*Attorney, Agent, or Firm*—Alexander J. McKillop; Michael G. Gilman; James P. O'Sullivan

[57] ABSTRACT

An apparatus and method for forming one or more pleats in a continuously advancing sheet of indeterminate length are provided. The apparatus includes a first roll, over which the sheet passes while a streak of adhesive is laid upon a selected strip of the sheet, and a composite roll, to which the sheet passes as a reach under selectively varied tension. The composite roll includes a parallel roll and an inclined roll which is inclined at a pleat angle to the parallel roll and is driven by rolling contact with the parallel roll while passing through a pinch zone at the apex of the pleat angle which is 0.25° to 5°, preferably about 1.5°. The periphery of the inclined roll may vary from a right circular cylinder to a right circular cone with its peripheral surface at a bevel angle to the circular side thereof. The bevel angle is preferably one half of the pleat angle. The pleat is formed by gathering the strip into the circularly converging gap between the inclined and parallel rolls and then lightly compressing the pleat between the sides of a circumannular recess between the rolls.

2 Claims, 14 Drawing Figures

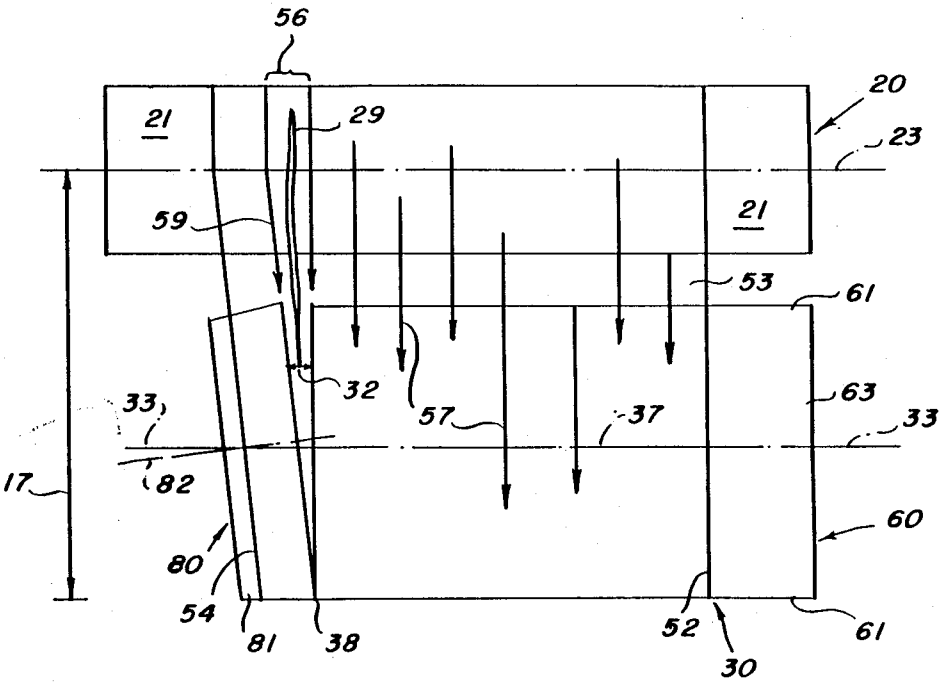
Fig. 2
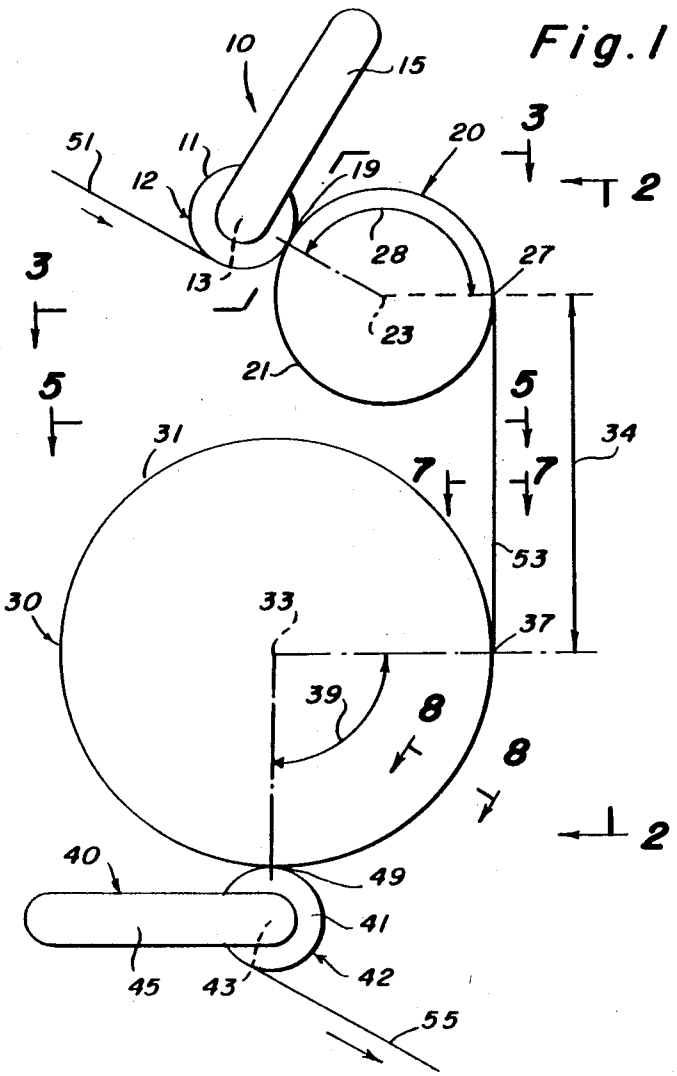

Fig. 4
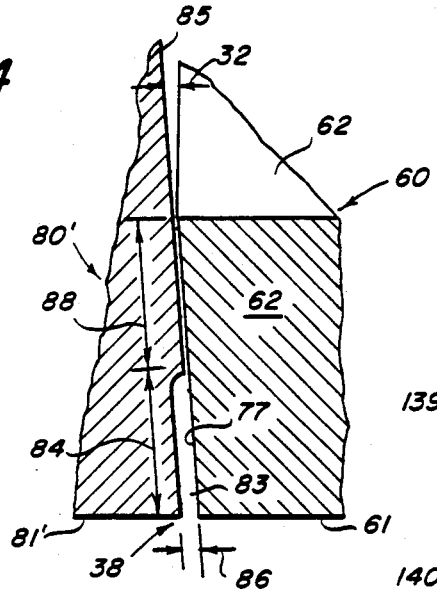
Fig. 13
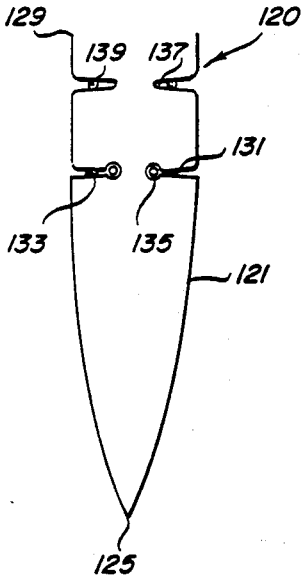
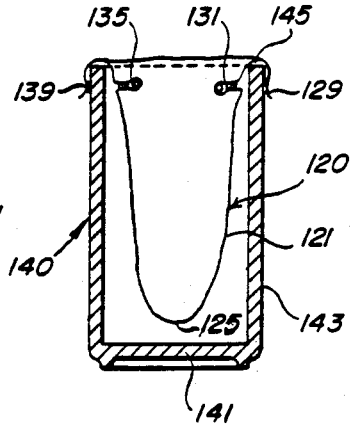
Fig. 14
Fig. 3
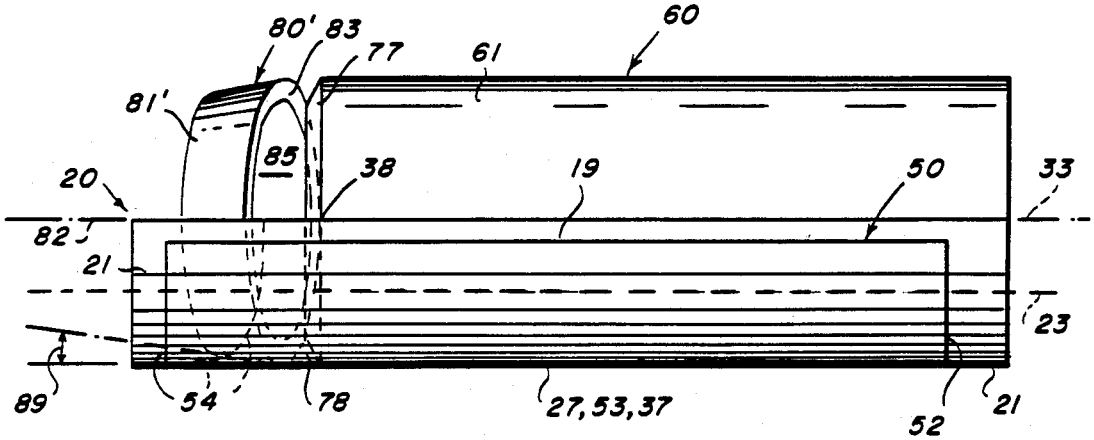

Fig. 7
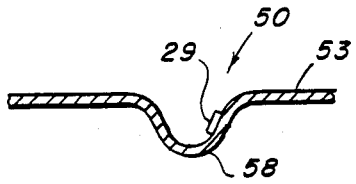
Fig. 8
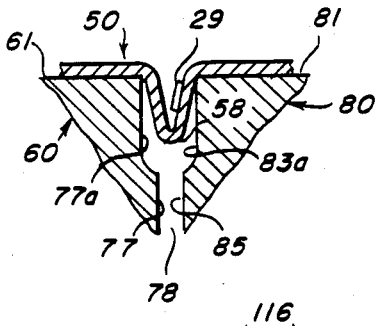
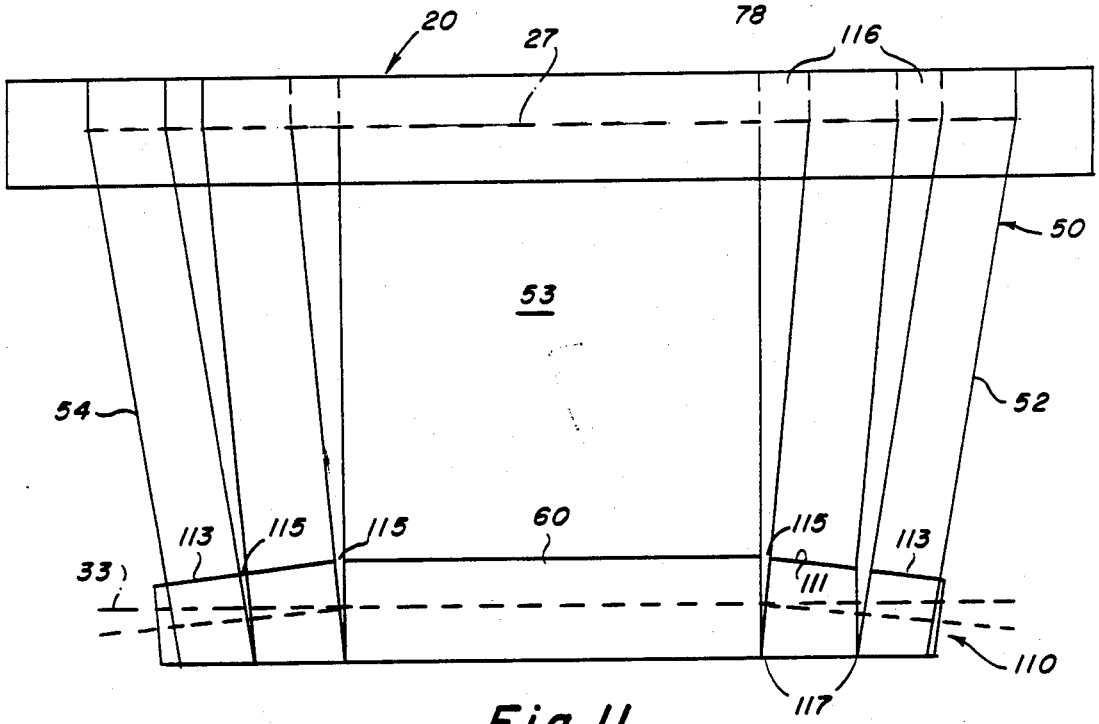
Fig. 11
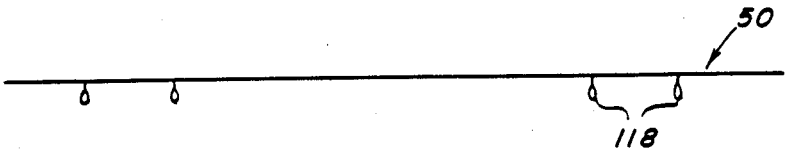
Fig. 12

SPLAYED ROLL FOLDER FOR ADHESIVE APPLICATION

This is a division of application Ser. No. 297,523 filed Aug. 28, 1981 now U.S. Pat. No. 4,419,087.

BACKGROUND OF THE INVENTION

Adhesive closures for bags, such as thin plastic sandwich bags, have been widely used. A transverse adhesive streak near the mouth of a sandwich bag is generally preferred for this purpose. However, a streak of exposed and unprotected adhesive adjacent to the mouth of such a bag structure has presented many drawbacks. When these bags are packaged within a dispensing carton, either in continuous roll form or individually adjacent to one another, the bags have a tendency to stick to one another as well as to exterior objects following dispensing of individual bags from the container, thus making it difficult to utilize the bags. In addition, the adhesives which are used are necessarily ralatively non-aggressive in an attempt to alleviate such problems, thereby making the closures less effective than would otherwise be possible.

An improved Z-fold adhesive striped closure has been described in U.S. Pat. No. 3,990,627 for protecting an adhesive streak extending across the front wall flap of a small bag, such as a sandwich bag. A fast and simple method and apparatus for making such Z-folds or pleats in a continuously advancing sheet is needed, however, particularly in the manufacture of sandwich bags which are serially connected in roll form by a perforated or weakened structure.

An additional device of the prior art has long been used for closing large plastic bags, such as trash bags. This device is a flexible strip of material such as paper, enclosing a bendable piece of metal wire. Such strips are commonly placed in the box of trash bags as an easily ruptured sheet or are adhesively attached to each bag by a piece of tape.

However, it would be far preferable to have each strip as an integral part of the bag structure. A convenient means for doing so is an adhesively secured pleat within which the closure strip is disposed, but no method or apparatus is available for forming such a pleat and placing the strip therein. Similarly, a drawstring can be placed within a pleat for subsequently closing the mouth of a bag by pulling upon both ends of the drawstring and then tying it.

A third area of interest in the prior art is the opening of plastic bags and other containers, such as foil-laminated bags for food products, shipping bags for fertilizer, animal feed and the like. Many of the bags are so tough and difficult to open that a piece of wire or string is sometimes attached to the bag structure to serve as a cutting tool. However, using the wire or string for its intended purpose is not always easy. A simple and reliable device for incorporating the wire or string into the bag structure and for readily using it to open the bag by slicing through the sheet material thereof would be a distinct advance in the art. A pleat enclosing the cutting material would provide this structure, but again the prior art provides no method or apparatus therefor.

SUMMARY OF THE INVENTION

The present invention solves these prior art problems and provides a method and apparatus for making a pleat which selectively encloses a streak of adhesive, a length of metal wire, a string, or another useful object for a variety of sealing, tying, or cutting purposes as desired by the user of structures incorporating the pleat which is made in a continuously advancing sheet of flexible material of indeterminate length, such as polyethylene or polypropylene film.

The apparatus of this invention, for folding a strip in a continuously advancing sheet of indeterminate length and for forming a pleat in the sheet, broadly comprises, in combination:

A. a tensioning means for subjecting a reach of the sheet to tension along a line of departure that is transversely disposed to the sheet; and B. a composite roll, comprising:

(1) a composite peripheral surface which receives the reach along a line of arrival thereon, the sheet thereafter traveling over the composite peripheral surface through a peripheral distance, (2) an imaginary axis of rotation that is disposed in parallel to the line of departure, and (3) two parts, having:

(a) axes of rotation which are inclined towards each other at a pleat angle, and (b) adjacent circular sides which form a circularly converging gap and are in revolving contact along a pinch zone, the tensioning means being disposed so that the peripheral distance extends through a peripheral angle of from 45° to 180° between the line of arrival and the pinch zone.

As one specific embodiment, the tensioning means comprises a first roll, having a first axis of rotation and a first peripheral surface on which the line of departure is disposed. In combination therewith, a first nip roller is in rolling contact with the first peripheral surface to form a first nip therebetween, the sheet being arranged to pass through this first nip. In further combination with the first roll, a second nip roller is in rolling contact with the composite peripheral surface to form a second nip therebetween at the pinch zone, the sheet similarly being arranged to pass through this second nip. As thus combined, the apparatus is most suitably arranged to operate with a peripheral distance of about 90°.

As another specific embodiment in combination with the first roll, the two parts are:

A. a first component roll which has a second axis of rotation and a second peripheral surface; and B. a second component roll which has a third axis of rotation and a third peripheral surface, the third axis of rotation being inclined at the pleat angle to the second axis and the third axis of rotation appearing to be disposed in parallel to the first axis when viewed in parallel to the reach, whereby the peripheral distance is 90°.

In general, the depth of the pleat is one half of the width of the strip that is measured on the first peripheral surface. This depth is measured, at a 90° wrap of the film over the composite peripheral surface, by the formula: $\frac{1}{2}$ projected distance $\times$ tangent of the pleat angle, the projected distance being the length of the reach plus the radius of the composite roll.

As a further specific embodiment, the first component roll is substantially wider than the second component roll. The first component roll is therefore generally disposed in parallel to the first axis of rotation, and the second component roll is an inclined roll.

The parallel and inclined rolls are operably arranged so that the circular side of the parallel roll, along the circularly converging gap, has a beveled surface adjacent to the second peripheral surface, and this beveled surface is beveled at the pleat angle from the perpendicular to the second peripheral surface. As one embodiment thereof, a portion of the beveled surface, adjacent to the second peripheral surface, herein is termed a pleat surface and the remaining portion thereof is termed a drive surface. A circumannular recess is provided in the circular side of the inclined roll or is alternatively provided in the pleat surface of the parallel roll. It is additionally satisfactory to provide mating recesses in the circular sides of both rolls.

This circumannular recess has an axially measured width equalling at least twice the thickness of the sheet, and, as a practical matter when a streak of adhesive is to be enclosed within the pleat, the width of the circumannular recess additionally equals the thickness of the streak, because it is generally not desirable to spread or smear the adhesive. Further, this width additionally equals the thickness of a cutting or closing device if it is to be enclosed within the pleat.

The circumannular recess has a radially measured width which is slightly greater than the width of the pleat and is equal to the radially measured width of the pleat surface. The circumannular drive surface, which is in rolling contact with a portion of the circular side of the inclined roll while passing by the pinch zone, is disposed radially inwardly of the recess.

As one specific embodiment, the third peripheral surface is the surface of a right circular cylinder, and as another embodiment, the third peripheral surface is the surface of a right circular cone. Indeed, the third peripheral surface is inclined at a bevel angle, measured from the third peripheral surface to the perpendicular to the circular side of the inclined roll, which can vary from 0° to about 5°. In general, this bevel angle is about one half of the pleat angle, and the pleat angle is from 0.25° to about 5°, preferably being 1.5°.

In the apparatus comprising a parallel roll and an inclined roll, the inclined roll is rotatably supported by a bearing assembly. The apparatus also comprises a hinged mounting assembly to which the bearing assembly is attached. A biasing means for pressing the inclined roll toward the parallel roll, whereby the inclined roll is driven entirely by contact of its circular side with the drive surface within the vicinity of the pinch zone, exerts a force at the drive surface that is from about one pound to about ten pounds.

A method for pleating a continuously advancing flexible sheet of indeterminate length according to this invention broadly comprises the following steps:

A. passing the sheet as a reach under selectively varied tension from a line of depature to a line of arrival; and B. passing the sheet under this tension and over a composite peripheral surface from the line of arrival to a pinch zone, through a peripheral distance subtended by a peripheral angle of from 45° to 180° and over a circularly converging gap having a pleat angle of from 0.25° to about 5° and ending at the pinch zone.

The pleat angle is suitably about 1.5° and the peripheral angle is suitably about 90°. Under these conditions, tension is exerted perpendicularly to the line of departure on one side of the gap and is oblique to the line of departure on the other side of the gap.

An improved method for forming and protecting an adhesive streak, in the manufacture of adhesive closure bags, is provided by this invention, comprising the following steps:

A. longitudinally depositing the streak, having a selected aggressiveness, along a selected strip on one side of a continuously advancing sheet of indeterminate length; and B. longitudinally pleating the strip, whereby the streak is entirely within the pleat and is adhesively attached to at least one interior surface of the pleat, by:

(1) passing the sheet under a selected tension from a striper roll to a composite roll which comprises a parallel roll and an inclined roll, this strip being approximately aligned with a circularly converging gap which is formed between the peripheral edge of the parallel roll and the adjacent peripheral edge of the inclined roll, and the adjacent circular sides of the inclined and parallel rolls being in rolling contact in the vicinity of a pinch zone at the convergence of the edges, whereby the sheet is longitudinally divided into a portion having parallel tension between the striper roll and the parallel roll and a portion having oblique tension between the striper roll and the inclined roll, (2) during the passing, transversely moving the oblique-tension portion toward the gap, and (3) forcing a strip of the obliquetension portion into the gap to form the pleat.

The gap generally subtends a pleat angle of from 0.25° to about 5° and is most suitably about 1.5°.

The width of the strip varies directly with the distance of the passing operation between the striper and composite rolls and additionally varies directly with the pleat angle. The forcing operation occurs through a peripheral wrap-around distance subtended by a peripheral angle of 45°–180°. Specifically, at a peripheral angle of 90°, the width of the strip is measured by the tangent of the pleat angle times the projected distance from the line of departure on the striper roll to the pinch zone. Although it is not necessary, the inclined roll is usually biased toward the parallel roll. Alternatively, or in combination with such biasing, the contact surface of the rolls may be provided with abrasive or roughened surfaces, as is known in the clutch art.

For sandwich bags and most consumer products, the streak of adhesive is a continuous length of a selected adhesive. However, the adhesive may alternatively be added at spaced intervals along the strip in order to secure a bendable segment which is placed in contact with the spaced adhesive and is aligned with the strip. This bendable segment may be a length of tying wire, a length of cutting wire, or a drawstring, to be used alternatively for closing or operning the bag.

DESCRIPTION OF THE DRAWINGS

FIG. 1 is a schematic side view of an apparatus for pleating a continuously advancing sheet of plastic material having an indeterminate length.

FIG. 2 is a schematic plan view of the striper roll and the composite roll of the invention, looking in the direction of the arrows 2—2 in FIG. 1, with arrows illustrating the parallel and sidewise movements of the sheet over the reach between the lines of contact of the sheet with these rolls and into the circularly converging gap between the inclined and parallel parts of the composite roll.

FIG. 3 is a schematic top view, taken in the direction of the arrows 3—3 of FIG. 1, of the striper roll and of a particular embodiment of the composite roll seen in FIGS. 1 and 2.

FIG. 4 is a sectional view of a portion of the composite roll of FIG. 3 at the pinch zone between the inclined and parallel parts of the composite roll.

FIG. 7 is a sectional view through the reach of the film sheet, looking in the direction of the arrows 7—7 in FIG. 1, showing the pleat as it is being initially formed.

FIG. 8 is another sectional view through the film sheet and the underlying composite roll, looking in the direction of the arrows 8—8 in FIG. 1, showing the pleat being folded further within the circularly converging gap of the composite roll.

FIG. 11 is a schematic plan view of a striper roll, a multi-piece roll, and a sheet passing between these rolls, similar to FIG. 2.

FIG. 12 is a schematic sectional view through a sheet having a plurality of pleats after it has passed over the multi-piece roll of FIG. 11.

FIG. 13 is a sectional elevation through both sides of a two-pleat trash bag having a drawstring pleat for holding a drawstring and closing the top of the bag and a sealing pleat for forming a sealing strip, the drawstring and sealing pleats having been made on the same side of the film.

FIG. 14 is a sectional elevation through a trash receptacle of conventional plastic construction into which the bag of FIG. 13 has been inserted and to the sides of which this bag has been adhesively attached.

DETAILED DESCRIPTION OF SPECIFIC EMBODIMENTS

Figure 5:
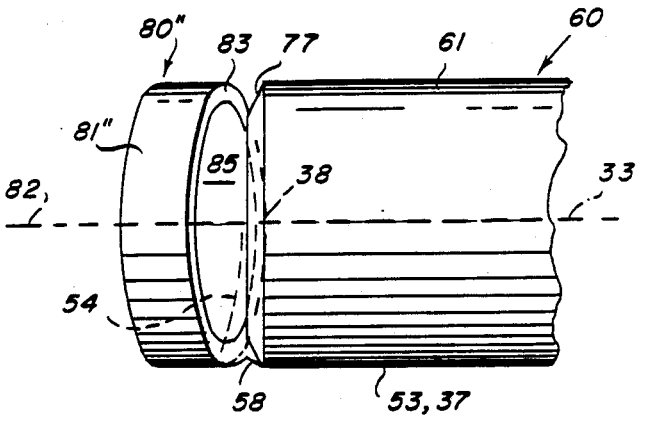
FIG. 5 is a schematic top view, taken in the direction of the arrows 5—5 in FIG. 1, of another specific embodiment of the composite roll seen in FIGS. 1 and 2.

Referring to FIG. 1, the apparatus of this invention broadly comprises a first nip roller assembly 10, a striper roll 20, a composite roll 30, and a second nip roller assembly 40.

The first nip roller assembly 10 comprises a roller 12, having a peripheral surface 11 and an axis of rotation 13, and an arm 15 which is pivotally attached at one end to a frame (not shown in the drawings) and is rotatably attached at its other end to a pin at axis 13. The striper roll 20 comprises a peripheral surface 21 and an axis of rotation 23.

A continually advancing sheet 50 of indeterminate length, as shown in FIGS. 1 and 2, approaches the apparatus as reach 51, passes under first nip roller 12 through a nip 19 between roller 12 and roll 20, and continues over surface 21 of striper roll 20, through a peripheral length measured by angle 28, to a line of departure 27. The sheet of film 50 passing over surface 21 through peripheral distance 28 is readily available for depositing at least one streak of adhesive 29 upon its outer surface.

As an alternative embodiment, line 27 can be the nip between a pair of nip rollers or can represent unrolling of a supply roll equipped with a constantheight mechanism. If a pair of nip rollers is used and if a streak of adhesive 29 is deposited on one side before the film reaches the rolls, the roller contacting this side is grooved to avoid contact with the adhesive streak.

The sheet of film being pleated leaves line 27 and travels as a tensioned reach 53 to a line of arrival 37 of composite roll 30. Sheet 50 then passes over surface 31 of composite roll 30 through angular distance 39 to nip 49 between composite roll 30 and second nip roller 42 and finally over the second nip roller to leave in the discharge direction as departing reach 55 which contains a pleat 55.

Instead of passing through nip 49, sheet 50 can leave roll 30 as a reach which extends from pinch zone 38 in the opposite direction to reach 55, whereby nip roller assembly is not needed. As seen in FIG. 2, film 50 has edges 52 and 54 as it passes in the form of reach 53 from striper roll 20 onto composite roll 30. Reach 53 is under selectively varied tension that is represented by vectors 57 and 59 and moves sidewise, in the direction of vector 59, according to the guidance provided by the composite peripehral surface of roll 30.

Composite roll 30 is to be understood as rotating on imaginary axis 33 and as comprising two or more composite rolls having axes of rotation which are inclined toward each other when viewed as seen in FIG. 2, while rotatively contacting each other along a pinch zone 38 which is close to peripehral surface 31. When viewed at 90° to the view of FIG. 2, however, these axes of rotation always appear as a straight line.

When two rolls are of approximately equal width, to form a pleat 58 in the middle of the advancing sheet of film 50, both of the rolls are preferably inclined with respect to roll 20. When the rolls are of unequal width, however, to form a pleat 58 which is near one edge 52,54 as seen in FIG. 2, it is generally more convenient that the wider roll be parallel to roll 20.

This configuration is shown in FIGS. 2, 7, 8, 9, and 10, wherein composite roll 30 comprises a wide roll 60, which is disposed in parallel to roll 20 and has axis 33 as its axis of rotation, and a narrow roll 80, having an axis of rotation which is inclined to the direction of travel of the sheet of film when rolls 20,30 are disposed as seen in FIGS. 1 and 2. These two rolls 60,80 are hereinafter designated for convenience as parallel roll 60 and inclined roll 80.

Rolls 60,80 are inclined to each other at pleat angle 32, whereby roll 80 has axis of rotation 82 which is incliend by pleat angle 32 to axis 33 when viewed at 90° to pinch zone 38, as seen in FIG. 2. Roll 60 has peripheral surface 61, and roll 80 has peripheral surface 91.

Specifically, as seen in FIGS. 1 and 2, composite roll 30 comprises a peripheral surface 31, a parallel roll 60, an inclined roll 80, a pleat angle 32, a pinch zone 38, a shaft 35, and an axis of rotation 33. The second nip roller assembly 40 comprises a roller 42, having a peripheral surface 41 and an axis of rotation 43, and an arm 45 which is pivotally attached at one end to the frame and is rotatably attached at the other end to a pin at axis 43.

Composite roll 30 can have any diameter that is reasonable and convenient, such as the same diameter as roll 20, and can be spaced from roll 20 at any suitable distance. However, this distance, illustrated by reach length 34, affects pleating performance.

Pleat 58 is formed from a strip on roll 20 having width 56 which is determined by the sidewise distance that film 50 moves together while travelling over distance 34 within reach 53 plus the sidewise distance that the film continues to move together within the gap after contacting composite roll 30. FIGS. 7 and 8 illustrate these stages of pleat formation. At the preferred wrap around over composite roll 30 of 90°, this width 56 is conveniently expressed in terms of a right triangle which is clearly seen in FIG. 2.

Therefore, when line of arrival 37 is about 90° from pinch zone 38 (i.e., angle 39 equals 90°), the depth of a pleat 58 is therefore ½ of width 56 which can be calculated by the formula: projected distance 17×tangent of pleat angle 32, wherein projected distance 17 is the sum of reach length 34 plus the radius of roll 30.

Pleat angle 32 is 0.25° to 5°, preferably 1.5°. When pleat angle 32 is small, such as 1.5° or less, there is relatively less edge distortion of the sheet of film. Edge distortion created by using a large pleat angle 32, however, can be alleviated by applying heat from infrared devices along edge 54 and/or strip 56.

If a relatively deep pleat 58 is needed, a larger pleat angle 32, a longer peripheral distance or wrap around distance corresponding to angle 39, a longer reach 53, or a combination of two or more of these variables, may be utilized. If reach 53 must be as short as possible, as another example, the same pleat depth can be obtained by increasing pleat angle 32 and/or by increasing the peripheral distance over surface 31.

This peripheral distance can be varied by changing the diameter of roll 30 or by changing the amount of wrap around roll 30, i.e., angle 39, which is preferably 90° but which can vary from 45° to 180°. The greater is angle 39, the shorter can be reach 53 or the smaller can be the diameter of composite roll 30, as embodied by parallel roll 60 and inclined roll 80, to obtain a desired pleating distance.

This strip of film having width 56, as seen in FIG. 2, can be identified throughout its length along the periphery of roll 20, and at any convenient place along this length a streak of adhesive 29 can be deposited and selectively solidified before reaching roll 30. As seen in FIGS. 7 and 8, the strip in roll 20 is progressively folded to form pleat 58 and enclose streak 29.

Instead of streak 29, a cutting or closing device, such as a piece of drawstring, a piece of cutting string or wire, a flexible tie strip, or the like can be longitudinally deposited on strip to be pleated, preferably in combination with a drop or two of adhesive for securing the device in place. If desirable to locate one or both ends of a short piece, such as a flexible tie strip which is disposed within a pleat 58, one or more portions of the pleat can be excised to expose one or both ends of the tie strip.

Surface 81 of inclined roll 80 can be the surface of a right circular cylinder or the surface of the frustum of a right circular cone, so that surface 81 is inclined at bevel angle 89 from the perpendicular to its circular side 83,85, as seen in FIGS. 3, 4, 5, and 6. Bevel angle 89 can, therefore, vary from 0° to about 5° or more and is preferably selected in accordance with such film characteristics as tendency to stretch, gage uniformity, evenness of edge 54, and the like, in order to minimize distortions along edge 54 and pleat 58. In general, bevel angle 89 is one half of pleat angle 32.

Looking from roll 20 along reach 53 toward roll 30, as in FIG. 3, an observer sees frustumshaped inclined roll 80' forming a convex outline (partly in phantom behind roll 20) where line of arrival 37 crosses circularly converging gap 78 between rolls 60,80. At pinch zone 38, as seen in FIG. 4, surfaces 61,81' form a linear outline. Guidance of film sheet 50 through the pleating distance is not affected by this convex relationship of peripheral surfaces 61,81' at line 37 or by the linear outline in the vicinity of pinch zone 38; instead such guidance is effected by the angular relationship of axes 33,82'.

Figure 6:
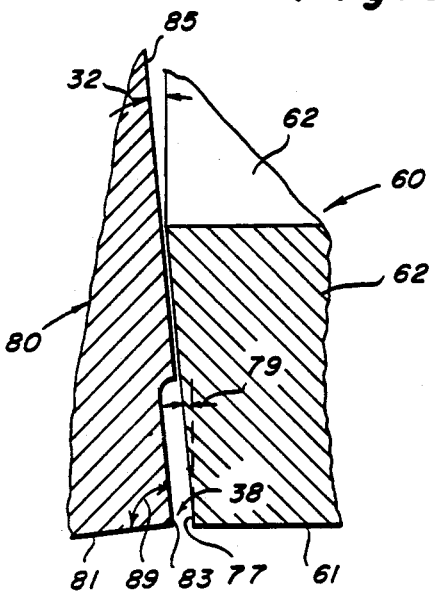
FIG. 6 is a sectional view of a portion of the composite roll of FIG. 5 at the pinch zone thereof, similar to FIG. 4.

Looking from beyond roll 20 along reach 53 toward roll 30, as in FIG. 5, an observer sees right-cylindrically shaped inclined roll 80'' forming a linear outline where line of arrival 37 crosses circular converging gap 78 between rolls 60,80''. At pinch zone 38, as seen in FIG. 6, surfaces 61,81'' form a concave outline. Again, however, directional guidance of film sheet 50 through the pleating distance is not affected by the linear outline along line of arrival 37 or the concave outline in the vicinity of pinch zone 38 and nip 49; it is the angular relationship between axes 33,82'' that is determining.

Accordingly, if bevel angle 89 is equal to pleat angle 32, beveled surface 81' is parallel to and aligned with surface 61 only when at pinch zone 38, as seen at the bottom of FIG. 4. At other angular positions along peripheries 61,81, as exemplified by beveled surface 81 on the opposite side of inclined roll 80 as seen in the middle of FIG. 2, beveled surface 81 is not at all parallel to surface 61 but forms a clearly convex angle therewith.

Figure 9:
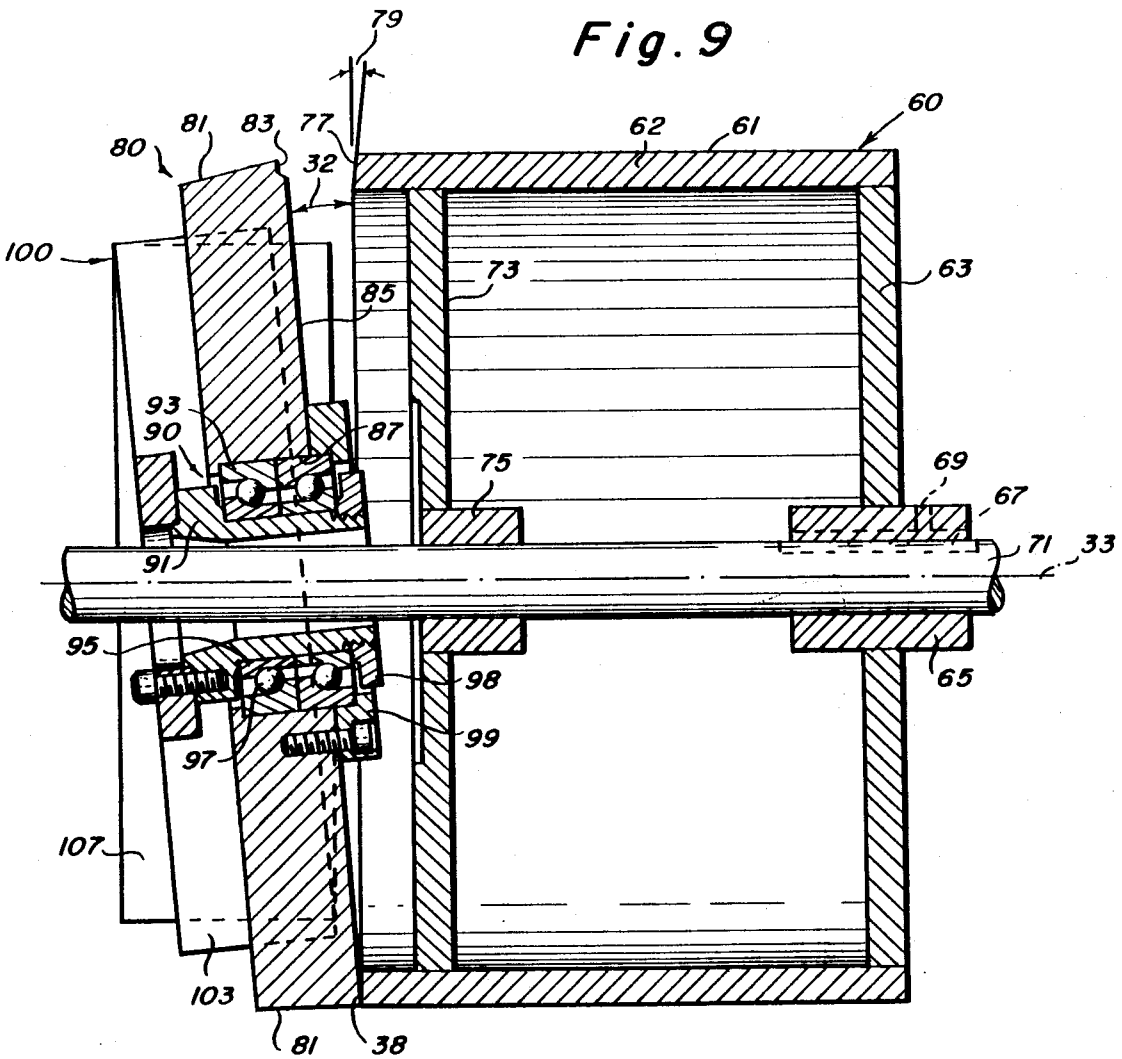
FIG. 9 is a longitudinal sectional view of the inclined and parallel parts of the composite roll, showing the system of angular-contact ball bearings used for support thereof.

As particularly shown in FIGS. 4, 6, and 9, inclined roll 80 is driven entirely by contact throughout pinch zone 38 along a contact portion of its inner side surface 85, near its periphery, with a contact portion of beveled surface 77 of roll 60. Beveled surface 77 is beveled at angle 79, which is generally equal to pleat angle 32, measured from the perpendicular to surface 61. Surface 83 is divided into a recess portion having depth 84 and a drive portion having remaining depth 88.

The radially measured depth 88 of such contact, as seen in FIG. 4, is limited by the thickness of cylindrical drum 62 minus the radially measured depth 84 of the pleat recess having side 83 and width 86 along pinch zone 38. Depth 88 is slightly greater than the depth of a pleat 58 to be produced within this circumannular recess. The recess can also be partly cut out of each roll 60,80, as seen in FIG. 8, wherein inclined roll 80 has a shallow recess with circumannular side **83*a* and parallel roll 60 has a matching shallow recess with circumannular side 77*a*, the total thickness being greater than the thickness of pleat 58**.

This width 86 between side 83 and surface 77 along pinch zone 38 is principally chosen in accordance with the thickness of the sheet of film being pleated and is always at least twice as great as the sheet thickness. In general, it is not desirable to squeeze adhesive streak 29. Therefore, width 86 is at least twice the thickness of film sheet 50 plus the thickness of film streak 29. Similarly, if a cutting or closing device, such as a piece of wire or string, is to be enclosed within pleat 58, thickness 86 is increased to accommodate its additional thickness.

The path of movement 57 within reach 53 is parallel to edge 52 as the corresponding portion of the sheet approaches parallel roll 60. However, the portion of sheet 50 approaching inclined roll 80 of composite roll 30 has an oblique path of movement (as indicated by vector 59) which is parallel to edge 54 of sheet 50. Inclined roll 80 and parallel roll 60 are inclined at pleat angle 32 to each other and circularly converge to pinch zone 38 which is 90° away from line of arrival 37, as seen in FIG. 2.

Parallel roll 60 comprises a cylindrical drum 62 having a peripheral surface 61, parallel circular sides 63,73, hubs 65,75, a shaft 71, a key 67 in a keyway within shaft 71 and hub 65, and a bolt 69 holding key 67 in place. Inner edge 77 of cylindrical drum 62 is also beveled at angle 79 along its entire circular periphery.

Inclined roll 80 of composite roll 30 is a solidly constructed annular disc with a large circular opening at its center, comprising a beveled peripheral surface 81, an inner circular side 85, a circumferential recess having circumannular side 83 at the outer edge of its inner side 85, and a stepped cylindrical hub surface 87 for insertion of bearing assembly 90. This circumferential recess can alternatively be in inner edge 77 of roll 60 or can be partially cut into circular sides 77,83 of both rolls 60,80.

Bearing assembly 90 comprises a mounting shaft 91 for inclined roll 80, ballbearings 97, an outer race 93 for ballbearings 97, an inner race 95 for ballbearings 97, a load nut 98 for mounting shaft 91, and a cap housing 99 for outer race 93. Outer race 93 is inserted into contact with hub surface 87. Load nut 98 threadably positions inner race 95 around mounting shaft 91. Cap housing 99 is attached with four bolts to inner side 85 of inclined roll 80.

The offset or inclined roll bearings are termed angular-contact bearings and are sold as Fafnir 720 Series ball bearings by the Fafnir Bearing Co., New Britain, Conn. These are duplex bearings with back-to-back mounting to provide axial and radial rigidity and equal thrust capacity in either direction when used in a fixed location.

Figure 10:
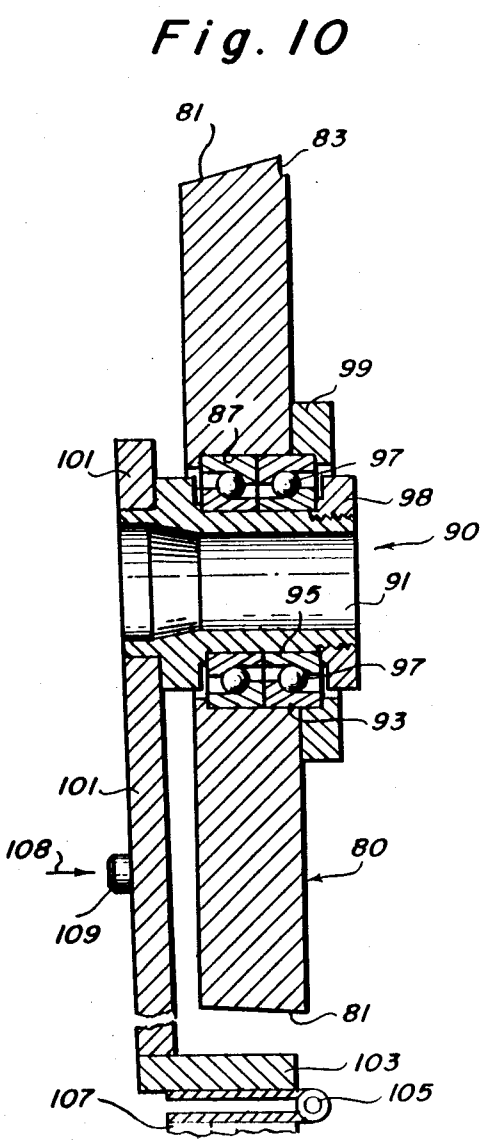
FIG. 10 is a longitudinal sectional view of the inclined part of the composite roll and of the hinge biasing device therefor, taken at 90° to the section shown in FIG. 9.

Hinge mounting assembly 100 is shown in both FIGS. 9 and 10. This assembly comprises a hinged bracket arm 101, a bracket 103 which is rigidly attached at right angles to arm 101, a hinge 105, and a base 107, hinge 105 being attached to both bracket 103 and base 107. A spring mounting pedestal 109 receives the biasing force 108 of a compressive spring having a force of 2 to 20 pounds, preferably 10 pounds, to exert a contact pressure of approximately 1 to 10 pounds, preferably 5 pounds, along the portion within pinch zone 38 of the annular strip of surface 85 having width 88, to effectuate driving contact with surface 77 of roll 60.

Composite roll 30 can be expanded from a two-piece roll to a multi-piece roll 110 having an axis of rotation 113, as seen in FIG. 11, which comprises a parallel roll 60, a pair of primary inclined rolls 111, and a pair of secondary inclined rolls 113. Strips 116 which are formed over roll 20 move together while entering circularly converging gaps 115 between rolls 60,111 and between rolls 111,113 to form pleats 118 within pinch zones 117, as seen in FIG. 12. Secondary rolls 112 are necessarily smaller than primary rolls 111 if these rolls are shaped as the frustum of a cone.

A plurality of pleats 118 are practicable for repeated sealing of bags and the like when dusty conditions destroy the usefulness of an adhesive streak after one use thereof. They are also helpful when one pleat can be peelingly opened for sealing purposes and another pleat can be aggressively sealed (as when two streaks of adhesive are placed in contact) and utilized for holding a drawstring or metal tie for closing purposes or for holding a cutting wire, for example, for opening purposes.

Moreover, two apparatuses of this invention can be combined in series to form one or more pleats on each side of a sheet of film by reversing the direction in which the striper roll and the two-piece or multi-piece roll rotate for each apparatus. The pleat which is thereby formed on the inside of a bag can be of substantial width, and by bringing together opposed streaks of adhesive, a very strong and effective interior seal can be obtained. Thereafter, the pleat which is thereby formed on the exterior of the bag can be used to close a protective flap, as in a sandwich bag, or to provide a tie as a back-up closing means or to provide a cutting tool in the form of a wire or monofilament. Such a combination is particularly helpful under field conditions for large bags when a hot-melt sealing machine is not available.

Manufacturing two-pleat trash bags is described in the following illustrative example and in FIG. 13. Usage of the Z-folds or pleats of FIG. 13 is illustrated in the accompanying FIG. 14.

EXAMPLE

A two-pleat strip-folding apparatus of the invention is set up for forming two closely spaced pleats on the same side of a continuously advancing sheet of indeterminate length. A supply of 1.5-mil polyethylene film is arranged to pass over the single two-pleat apparatus (arranged as on the left side of apparatus 110 in FIG. 11), forming two continuous and relatively large pleats 131,137, and then on to a winder. The wound roll is subsequently unwound onto a transverse cutting means which separates the pleated film into a large plurality of transversely extending strips which then move at 90° to a folding apparatus and finally to an edge sealing apparatus, forming a plurality of trash bags 120 having the sectional configuration shown in FIG. 13. The pleats and portions of this bag 120 are referred to hereinafter while describing the pleating operations.

As first pleat 131 begins to be formed on the striper roll, a streak of adhesive 133 is added along one outer edge only. Streak 133 is narrow, very aggressive, and highly viscous, so that it spreads very little, even though not pre-cooled, while passing through the pinch zone. A continuous length of drawstring 135 is then laid in the center of pleat 131 without substantial contact with adhesive 133. Preferably, however, there is sufficient contact with the adhesive that the drawstring will not slip endwise out of the pleat prior to use but can be broken free by a moderate pull during use thereof.

As a second strip begins to be folded while passing over the striper roll for making attachment pleat 137, a streak of adhesive 139 is deposited thereon in the same manner as streak 29, as shown in FIG. 2. Adhesive streak 139 is substantially pre-cooled before passing through the pinch zone.

After the pleated film has passed through the cutting operation, the transverse moving operation, and the edge sealing operation, bags 120 are formed, each having folded bottom edge 125, sides 121, top edge 129, and two pleats 131,137 which are both on the inside of the bag. When the side edges are cut, drawstring 135 is also severed. However, its ends are easily accessible because pleat 131 is wide enough to insert fingers for grasping the cut ends of drawstring 135.

These pleats are utilized as shown in FIG. 14 in combination with a trash receptacle 140 having bottom 141, sides 143, and top edge 145. Beginning at the top of bag 120, pleat 137 is snapped open, after bag 120 has been inserted into trash receptacle 140, and adhesive streak 139 is pressed against sides 143, near top edge 145 of the receptacle, so that bag 120 does not fall down inside the receptacle.

After bag 120 has become substantially filled with trash, adhesive streak 139 is pulled away from sides 143 and pressed against adjacent portions of side 121, essentially reforming pleat 137 in order to obviate sticking to the user's hands.

Pleat 131 is then utilized by pulling upon the exposed ends of drawstring 135 and tying drawstring 135, whereby the filled bag 120 is suitable for immediate disposure.

After testing, it is found that bag 120 has a distinct handling advantage, with respect to closing when nearly filled, over bags of the prior art which require one hand to be used for squeezing the topmost few inches of a nearly filled bag while the other hand makes a desperate attempt to secure a tie strip around the slippery film. Moreover, bag 120 can contain a larger amount of trash than the prior art bags because its upper portion need not be compressed as much as these bags in order to shorten its drawstring 135 sufficiently to effectuate closure thereof.

What is claimed is:

1. A method for pleating a continuously advancing flexible sheet of indeterminate length, comprising the following steps:

A. passing said sheet as a reach from a line of departure to a line of arrival; and applying selectively varied tension to said sheet at least at said line of departure and obliquely relative to said line of departure B. passing said sheet under tension and over a composite peripheral surface from said line of arrival to a pinch zone, through a peripheral distance subtended by a peripheral angle of from 45° to 180° defined by said peripheral surface and over a circularly converging gap having a pleat angle of from about 0.25° to about 5° and ending at said pinch zone and;

C. forcing a strip of said sheet into said gap by means of said oblique tension on said sheet so as to form in said sheet a pleat parallel with the edges of said sheet.

2. The method of claim 1, wherein said pleat angle is about 1.5° and said peripheral angle is about 90°.

* * * * *